US005439220A

United States Patent [19]

Hendricks

[11] Patent Number: 5,439,220

[45] Date of Patent: Aug. 8, 1995

[54] PUZZLE GAME

[76] Inventor: Ronald F. Hendricks, 233 Lamplighter La., Marietta, Ga. 30067

[21] Appl. No.: 263,997

[22] Filed: Jun. 22, 1994

[51] Int. Cl.[6] ..... A63F 9/08

[52] U.S. Cl. ..... 273/155; 273/157 R

[58] Field of Search ..... 273/155, 157 R, 157 A, 273/159, 282.1, 282.2, 283

[56] References Cited

U.S. PATENT DOCUMENTS

| | | | |
|---|---|---|---|
| 1,359,115 | 11/1920 | Sittinger | 273/157 R X |
| 2,011,058 | 8/1935 | Krase | 273/157 |
| 2,333,731 | 11/1943 | Monroe et al. | 273/155 |
| 3,550,945 | 12/1970 | Resnick | 273/157 |
| 3,606,338 | 9/1971 | Cannata | 273/157 |
| 4,053,159 | 10/1977 | Kulak | 273/157 |
| 4,336,664 | 6/1982 | Penick et al. | 273/157 R X |
| 4,586,714 | 5/1986 | Lenkoff et al. | 273/157 R |
| 4,745,424 | 5/1988 | Cardaire | 273/157 R X |
| 4,756,533 | 7/1988 | Hopkins et al. | 273/157 R |
| 4,778,153 | 10/1988 | Bachman et al. | 283/101 |
| 4,838,551 | 6/1989 | Volpert | 273/157 R |
| 4,893,817 | 1/1990 | Shilo | 273/157 R |
| 5,149,570 | 9/1992 | Cain | 428/33 |
| 5,156,698 | 10/1992 | Roberts | 156/108 |
| 5,219,168 | 6/1993 | Morris | 273/157 R |

FOREIGN PATENT DOCUMENTS

| | | | |
|---|---|---|---|
| 0662954 | 11/1987 | Switzerland | 273/157 R |
| 2196542 | 5/1988 | United Kingdom | 273/157 R |
| 9100758 | 1/1991 | WIPO | 273/157 R |

*Primary Examiner*—William E. Stoll
*Attorney, Agent, or Firm*—Kennedy & Kennedy

[57] ABSTRACT

A puzzle has a backing card overlaid with a peel-off sheet. The peel-off sheet has a tacky obverse side which is in intimate contact with a releasable surface of the backing card. The peel-off sheet is cut into segments with each segment bearing a portion of a scrambled image on its face side. Upon removing at least some of the segments and rearranging them on the backing card, the peel-off sheet displays the image unscrambled. The incorporation of the puzzle into a book is also disclosed.

1 Claim, 2 Drawing Sheets

PUZZLE GAME

TECHNICAL FIELD

The present invention relates to puzzles. More particularly, the invention relates to puzzles having a plurality of segments that in a particular arrangement form an image.

BACKGROUND OF THE INVENTION

Puzzles are available in many forms for recreational use and are designed to be suitable for all ages. Jigsaw type puzzles typically are provided with many loose pieces varying in size and shape. Each piece bears a segment of an image. Upon assembling the pieces in a particular arrangement with adjacent pieces interlocked, the image is displayed.

When solving a puzzle, there are several inherent limitations that a person must consider. For example, the location where the puzzle is to be assembled must be carefully chosen. Typically, a flat surface in a nonjarring setting is preferred. Once a person has begun the task of assembling the puzzle, the puzzle must remain still until completed to prevent the assembled portion of the puzzle from becoming disassembled.

Some puzzles are provided with a mounting board that contains a well in which the pieces are assembled. The mounting board helps prevent movement of the assembled pieces and provides a suitable vehicle for moving the assembled pieces from one location to another. However, if the frame is accidentally jarred or dropped the assembled work would likely become unassembled.

Other puzzle pieces, as disclosed in U.S. Pat. No. 2,011,058 to Krase, have adhesive contacting surfaces. The pieces adhere to each other along their side edges by the exertion of a small amount of pressure applied while fitting the pieces together. The construction of this type puzzle requires lamination of a layer of adhesive substance between two other layers. A proper working surface such as a table or floor is still required.

In U.S. Pat. No. 5,149,570 to Cain puzzles are provided with a means of mounting the assembled pieces in a fixed position. Here puzzle pieces with adhesive backings are covered with release sheets. Upon removal of the release sheets, puzzle pieces may be fixed to a mounting surface. This is advantageous if the puzzle is to be framed and displayed. However, the puzzle may not be conveniently unassembled and assembled again without the risk of destroying the pieces.

Since puzzle pieces typically vary in shape and size, they are either supplied loose or in their unscrambled, solved configuration. Accordingly, the unassembled puzzle pieces are easily lost. The pieces may be misplaced or if pieces fall to the floor unnoticed, a pet or small child might carry off the pieces. Also, in the transfer of the puzzle from one location to another, pieces may simply be dropped en route. Once a piece is missing, the puzzle may never be completed.

Thus, there exists a need for a puzzle in which the risk of jarring and losing the puzzle pieces during assembly is significantly reduced, the location of assembly is not restricted, the puzzle pieces are supplied unassembled yet not loose, and the puzzle pieces once assembled to display the image may be reused. Accordingly, it is to the provision of such an improved puzzle that the present invention is primarily directed.

SUMMARY OF THE INVENTION

In a preferred form of the invention a puzzle comprises a backing card having a releasable surface overlaid with a peel-off sheet. The peel-off sheet has a tacky obverse side which is in intimate contact with the releasable surface of the backing card. The peel-off sheet is cut into a plurality of segments, each of which bears a portion of a scrambled image on its face side. Upon removing at least some of the segments and rearranging them on the backing card, the peel-off sheet displays the image in an unscrambled configuration.

According to another preferred embodiment, a book comprises a plurality of bound sheets with some of the sheets bearing a fixed printed image and with the other of the sheets bearing a transformable image. The other sheets comprise a backing card having a releasable surface overlaid with a peel-off sheet which is cut into a plurality of segments. Each segment bears a portion of the transformable image on its face side and has a tacky obverse side in intimate contact with the releasable surface of the backing sheet. The pieces are removed from the backing sheet and rearranged into another transformable image onto the backing sheet.

DETAILED DESCRIPTION OF THE INVENTION

Figure 1:
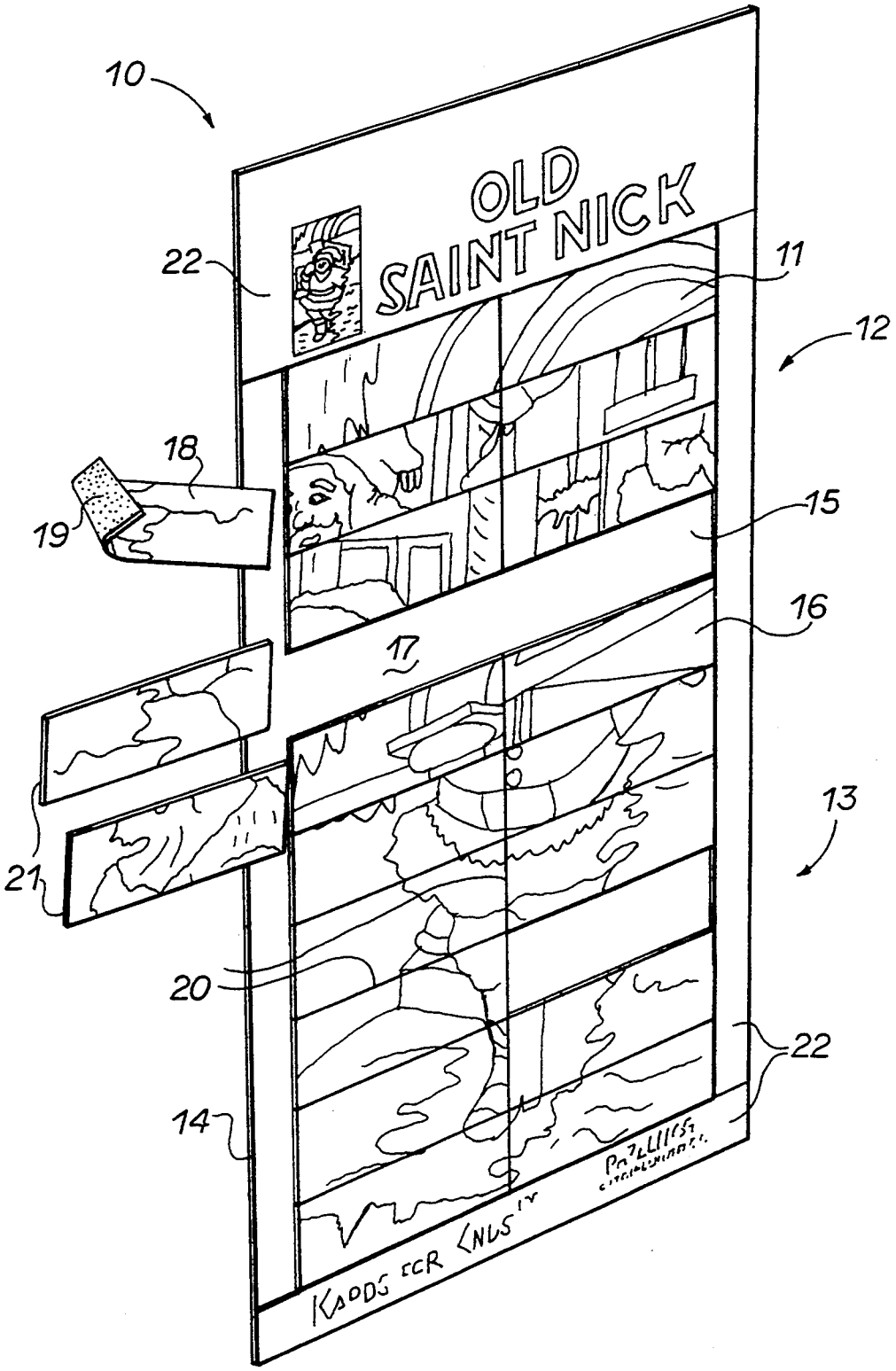
FIG. 1 is a perspective view of a card embodying the invention in a preferred form.

Referring now in more detail to the drawings, in which like numerals indicate like parts, a puzzle card 10 is shown in FIG. 1 displaying an image 11 which for purposes of illustration is shown scrambled on the top half 12 of the card and unscrambled on the bottom half 13 of the card. The puzzle card 10 is a double layer sheet 14 comprising a backing card 15 overlaid with a peel-off sheet 16. The backing card 15, referred to in the paper industry as a tag liner, has a non-tacky, releasable surface 17. The peel-off sheet 16, is a thin removable cover with a printed surface 18 displaying the image 11 and an obverse tacky surface 19. The tacky surface 19 is a coating of pressure sensitive adhesive. As so far described the card 10 is of conventional construction such as that sold by Fasson, Inc. of Painesville, Ohio under the trademark FASCAL which is used primarily for labels.

In accordance with the invention, the peel-off sheet 16 here is die cut where indicated at lines 20 into twenty image segments 21 and four frame segments 22. The lines 20 are impressed on the surface of the backing card 15 providing guidelines for use in unscrambling the image 11 as described below. The image segments 21 each display a portion of the image 11. For illustrative purposes, the image 11 is that of Old Saint Nick. However, any pictorial or textual image may be used. The image segments 21 are shown all of the same size and shape and arranged in two columns. The image segments 21, however, may vary in shape, size, arrangement and number, if desired. The four frame segments 22 provide two horizontal borders, one of which is sufficiently wide enough for a title and area to display the unscrambled image, and two vertical borders. One of the vertical borders has been removed in FIG. 1 to show how to use the puzzle as discussed below.

The puzzle card 10 is supplied with the image 11 scrambled. For convenience in unscrambling the image 11, the image segments 21 are preferably scrambled within each column. To unscramble the image 11, the image segments 21 are removed from the backing card 15 by slightly flexing the backing card 15 at one of the lines 20 and peeling off the individual image segments 21 of the peel-off sheet 16. The adhesion between the tacky surface 19 of the peel-off sheet 16 and the releasable surface 17 of the backing card 15 is such that the two pieces readily release from each other. When reapplied to the backing card 15, the image segments 21 are readily received by the backing card with a slight application of pressure.

A person typically needs to remove several image segments 21 from the puzzle card 10 such that the area where the image segments need to be replaced for unscrambling the image 11 is exposed. When several adjacent image segments 21 are removed, the lines 20, which are impressed in the surface of the backing card 10, are visible to facilitate correct replacement of the image segments. Additionally, the image segments 21 are scrambled amongst themselves within one of the columns to allows for easier manipulation of the image segments.

Prior to solving the puzzle, a working area may be provided by removing one of the frame segments 22 from the backing card 15. As shown in FIG. 1, one of the vertical borders has been removed to expose the releasable surface 17 underneath. The image segments 21 are temporarily fixed to the releasable surface 17 prior to reapplication onto the backing card 15 in the unscrambled configuration. Having this working area made of the releasable surface 17 facilitates solving the puzzle since the image segments are not readily releasable from other surfaces. A further advantage is that all segments may remain at most all times attached to the card, which allows a person to solve the puzzle card 10 nearly any place without the necessity of a level playing surface typically required with conventional puzzles. In particular, the puzzle card 10 is easily played with while riding in an automobile.

Figure 2:
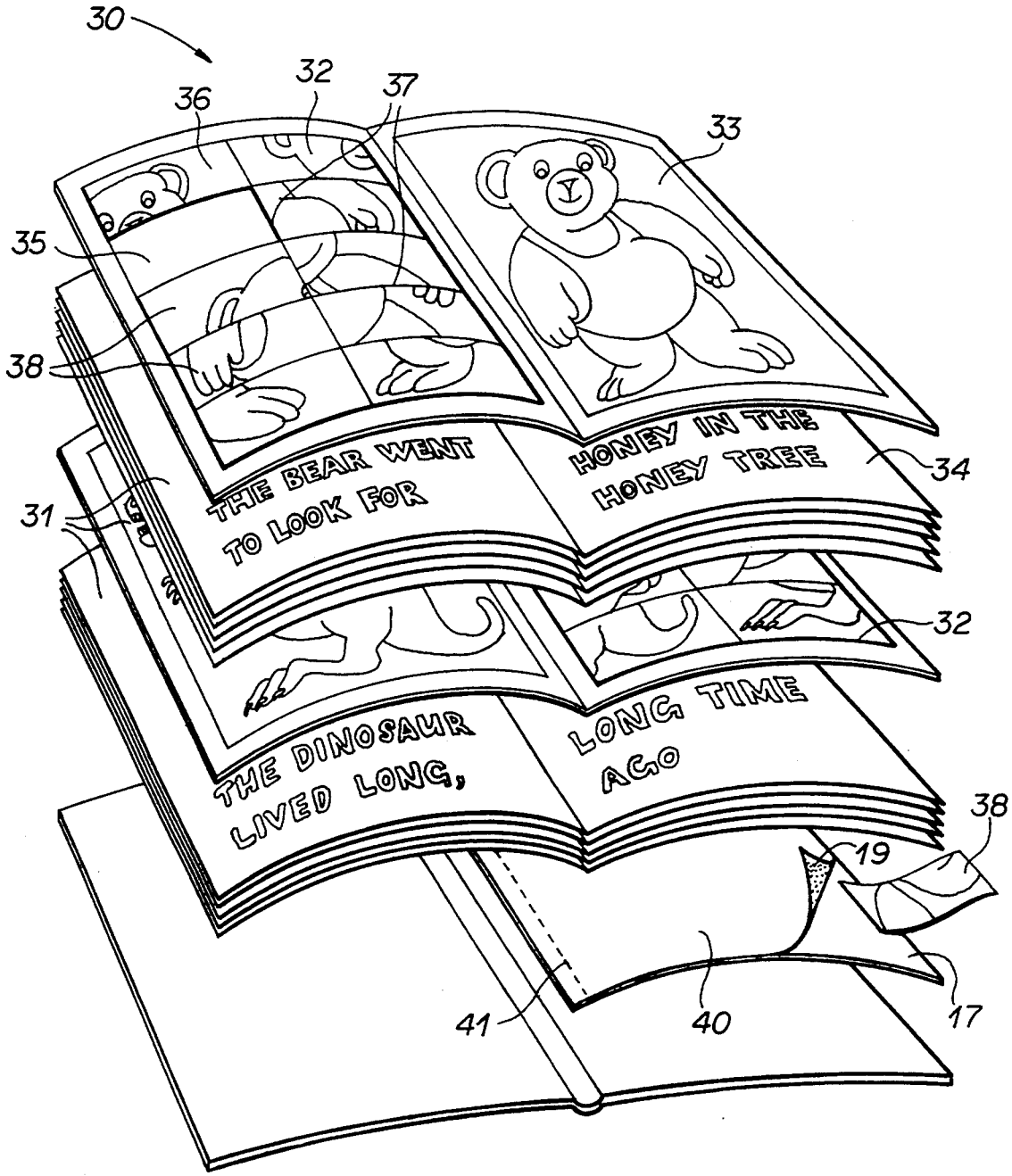
FIG. 2 is an exploded view of a book embodying the invention in another preferred form.

Referring now to FIG. 2, a book 30 is shown that also embodies principles of the invention. The book 30 has conventionally bound printed pages 31 and double layer pages 32 both of which may bear either pictorial images 33 or textual images 34, or combinations thereof. The double layer pages 32 are located at various positions in the book 30 and, as shown, are often opposite a conventional printed page 31. The double layer pages 32 may also be paired with another double layer page 32.

The double layer pages 32 are made from the same materials as the double layer sheet 14 of the puzzle card 10. Similar to the puzzle card 10, the double layer pages 32 have a backing sheet 35 overlaid with a peel-off sheet 36. The peel-off sheet 36 displays a scrambled pictorial image 33 of a bear here and is cut at lines 37 into image segments 38. Lines 37 also are impressed into the backing sheet 35. The image segments 38 display a portion of the pictorial image 33. As shown here, the image segments 38 are the same size and shape and arranged in two columns. The image segments 38, however, may vary in shape, size, arrangement and number. The book 30 here also contains a double layer blank page 40 having a perforation 41 for removing the blank page 40 from the book 30.

The double layer pages 32 of the book 30 are supplied with the image 33 scrambled, similar to the puzzle card 10. To unscramble the image 33 the image segments 38 are removed from the backing sheet 35 by slightly flexing the backing sheet 35 at one of the lines 37 and peeling off the individual image segments 38. For convenience, the blank page 40 is removed from the book 30 along the perforation or score line 41 and used as a working area. The peel-off sheet 36 of the blank page 40 is removed from the backing sheet 35 to expose the releasable surface 17. The image segments 38 are temporarily fixed to the releasable surface 17 prior to reapplication onto the backing sheet 35 in the unscrambled configuration.

This book 30 not only has the advantages as described above for the puzzle card, but also utilizes these advantages to produce a unique combination and interrelation of book and puzzle. The puzzles are dispersed amongst the stories providing analytical and reading stimulus at the same time. Being both a book and puzzle, a solution to a puzzle on one page may be fixedly displayed on a successive facing page, as shown in FIG. 2, or hinted at in a narration on that page. Also, as a book/puzzle combination, all components are held together by the book binding and the tacky surface of the peel-off sheets resulting in a product that may be easily enjoyed while traveling in an automobile. Thus, the book has a tremendous amount of versatility.

While this invention has been described in detail with particular references to the preferred embodiments thereof, it should be understood that many modifications, additions and deletions may be made thereto without departure from the spirit and scope of the invention as set forth in the following claims.

What I claim is:

1. A puzzle comprising a backing card having a releasable surface overlaid with a plurality of segments bearing a portion of a scrambled image, said segments having a tacky obverse side in intimate contact with said releasable surface of said backing card and wherein said segments are of the same rectangular size positioned in two side by side columns, and wherein one half of said image is scrambled in one of said side by side columns and the other half of said image is scrambled in the other of said side by side columns, whereby upon removing at least some of the segments and rearranging the segments on the backing card the segments display the image unscrambled.

* * * * *